US006472807B1

(12) United States Patent
Yoon

(10) Patent No.: US 6,472,807 B1
(45) Date of Patent: Oct. 29, 2002

(54) BRAUN TUBE FRAME HAVING LONG AND SHORT SIDES OF A SPECIFIED HEIGHT

(75) Inventor: Thae Seok Yoon, Inchon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/549,522

(22) Filed: Apr. 14, 2000

(30) Foreign Application Priority Data

Apr. 15, 1999 (KR) ..... 99-13377

(51) Int. Cl.[7] ..... H01J 29/80
(52) U.S. Cl. ..... 313/407; 313/406
(58) Field of Search ..... 313/402, 404, 313/406, 407, 408

(56) References Cited

U.S. PATENT DOCUMENTS 4,622,490 A * 11/1986 Benway ..... 313/402
5,550,428 A * 8/1996 Kume et al. ..... 313/407
5,554,909 A * 9/1996 Brennesholtz ..... 313/402
5,742,116 A * 4/1998 Maki et al. ..... 313/402
5,751,098 A * 5/1998 Ito et al. ..... 313/402
6,046,535 A * 4/2000 Jung ..... 313/402
6,064,146 A * 5/2000 Lee ..... 313/407
6,130,500 A * 10/2000 Park et al. ..... 313/402
6,268,688 B1 * 7/2001 Tani et al. ..... 313/402
6,274,974 B1 * 8/2001 Ito et al. ..... 313/402

* cited by examiner

*Primary Examiner*—Michael H. Day
*Assistant Examiner*—Mack Haynes
(74) *Attorney, Agent, or Firm*—Birch, Stewart, Kolasch, & Birch, LLP

(57) ABSTRACT

A Braun tube including a shadow mask, a panel for supporting the shadow mask, stud pins fitted between the shadow mask and the panel, and a frame of substantially rectangular form having a long side with a height in a range of (0.8–0.9)×(a height from a center of the stud pin to a central point of an inside surface of the panel), and a short side and a corner side each with a height in a range of (0.7–0.85)×(the height of the long side), thereby making the Braun tube stable from influences from doming, howling, and geomagnetism by optimizing respective heights of the frame to satisfy various requirements for the Braun tube at the same time when an overall size of the frame is increased, and permitting convenience of design.

4 Claims, 4 Drawing Sheets

BRAUN TUBE FRAME HAVING LONG AND SHORT SIDES OF A SPECIFIED HEIGHT

BACKGROUND OF THE INVENTION

1. Field of the Invention

The present invention relates to a Braun tube, and more particularly, to a frame for supporting a shadow mask fitted to a panel of a Braun tube.

2. Background of the Related Art

The Braun tube in a TV receiver having red, green and blue fluorescent materials become luminous by a video signal for reproducing a color image. FIG. 1 illustrates a related art color Braun tube.

That is, the related art Braun tube is provided with a panel 1, a funnel 2 and a neck portion 12. There are stud pins 3 and a fluorescent surface 4 having a fluorescent material layer formed thereon on an inside surface of the panel 1, and there is a shadow mask assembly in the panel 1. The shadow mask assembly has a frame 8, a shadow mask 9 supported by the frame inside of the frame 8, and a spring 10 fastened between the frame 8 and the stud pin 3 for supporting the frame 8 from an inside of the panel 1. There is a bead 8*a* formed on an inside surface of the frame for supporting a skirt portion 9*b* of the shadow mask 9, and a flat portion 8*b* at each corner of the frame for smoother coupling with the spring 10. And, there is an inner shield 11 in rear of the frame for preventing deviation of a path of electron beams 5 caused by an external geomagnetism or leakage magnetism.

The shadow mask assembly should meet the following characteristics for smooth operation of the Braun tube.

First, the thermal expansion of the shadow mask components caused by the electron beams 5 during operation of the Braun tube should be suppressed. The thermal expansion of the shadow mask caused by the electron beams 5 hitting the shadow mask causes doming in which a displacement of the shadow mask occurs.

Second, the rectangular frame 8 should be always held fixed at one position inside of the panel 1, because the howling of the shadow mask 9 occurring during operation of the Braun tube, or by external impact, deteriorates color selection performance of the shadow mask 9.

Third, the variation of landing caused by geomagnetism with an operation direction of the Braun tube should be small, because, though the electron beams 5 should pass through respective slits 9*a* in the shadow mask 9 in a state wherein initially set emission angles are maintained exactly, the external magnetism affects paths of the electron beams, causing the electron beams 5 to deviate from their exact positions.

In the related art, in order to meet the requirements for the Braun tube, materials of the shadow mask 9 and the frame 8, shape and material of the spring 10, material and shape of the inner shield 11 are modified, appropriately, particularly the shadow mask is formed of an invar alloy for suppressing the doming caused by the thermal expansion to the maximum, because the invar alloy is an approx. 36% Ni—Fe alloy with a very low thermal expansion coefficient. However, even though deformation of the shadow mask 9 by the heat is very small, deformation of the frame 8 is very severe considering that in general the frame 8 has a thermal expansion coefficient of $1.2\times10^{-5}$. Accordingly, in the related art, a structure (or shape) of the spring 10 which supports the frame 8 inside of the panel 1 is varied for reducing the misalignment. However, since the spring should be fabricated considering, not only the supporting of the frame 8, but also the misalignment of the shadow mask 9, the design of the spring has been difficult. And, in the related art, the external magnetism is shielded by providing the inner shield 8 fitted from rear side of the frame 8 along an inside of the panel 1 for adjusting a magnetic flux density at a center in the inner shield and magnetic flux density outside of the inner shield, appropriately. However, the related art frame 8 has a size generally smaller than the panel 1. Accordingly, the space in which the electron beams 5 pass through on the inside space of the frame is small such that a magnetic flux density at the center portion of the frame 8 becomes similar to the magnetic flux density at a periphery of the inside of the frame. That deteriorates the magnetic shielding effect sharply, and the low height of the frame 8 causes the magnetic flux to fail to concentrate into long and short sides, and corners of the inner shield 11, resulting in the magnetic flux density at the center and the periphery of the inside of the panel to be similar. The similar magnetic flux densities can not reduce the path variation caused by the external magnetism, deteriorating the external magnetism shielding effect sharply, which increases variation of landing of the electron beams.

Taking the aforementioned different problems and the current trend in which the Braun tube is gradually planarized into consideration, there is a limitation in that the aforementioned various requirements for the Braun tube are met by varying materials, or shapes of the shadow mask 9, the spring 10 and the inner shield 11. That is, the small enclosing volume of the related art frame 8 leads to a greater temperature rise of the frame 8 by the electron beams 5, and the low height of the related art frame 8 leads to a greater distortion of the shadow mask in fabrication or in operation of the Braun tube because the related art frame 8 can not enclose an outer circumference of the shadow mask 9 formed in correspondence to the planarization of the panel 1, adequately. The low shielding effect in a space between the panel 1 and the shadow mask 9 caused by the low height of the frame 8 results in a large variation of the landing. In view of the foregoing discussion, it can be known that, since an inside surface curvature of a panel becomes greater than the curvature of the related art panel 1 as the Braun tube becomes the flatter, the height of the frame 8 should be made higher for minimizing variation caused by the geomagnetism in change of direction. However, mere increase of an overall frame height along with the increase of the inside surface curvature of the panel 8 may in turn cause a problem in that doming and howling can not be prevented, effectively.

SUMMARY OF THE INVENTION

Accordingly, the present invention is directed to a frame in a Braun tube that substantially obviates one or more of the problems due to limitations and disadvantages of the related art.

An object of the present invention is to provide a Braun tube which is stable from influences of doming, howling and geomagnetism.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the Braun tube includes a shadow mask, a panel for supporting the shadow mask, stud pins fitted between the shadow mask and the panel, and a frame of substantially rectangular form having a long side with a height in a range of (0.8–0.9)×(a height from a center of the stud pin to a central point of an inside surface of the panel), and a short side and a corner side each with a height in a range of (0.7–0.85)×(the height of the long side).

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
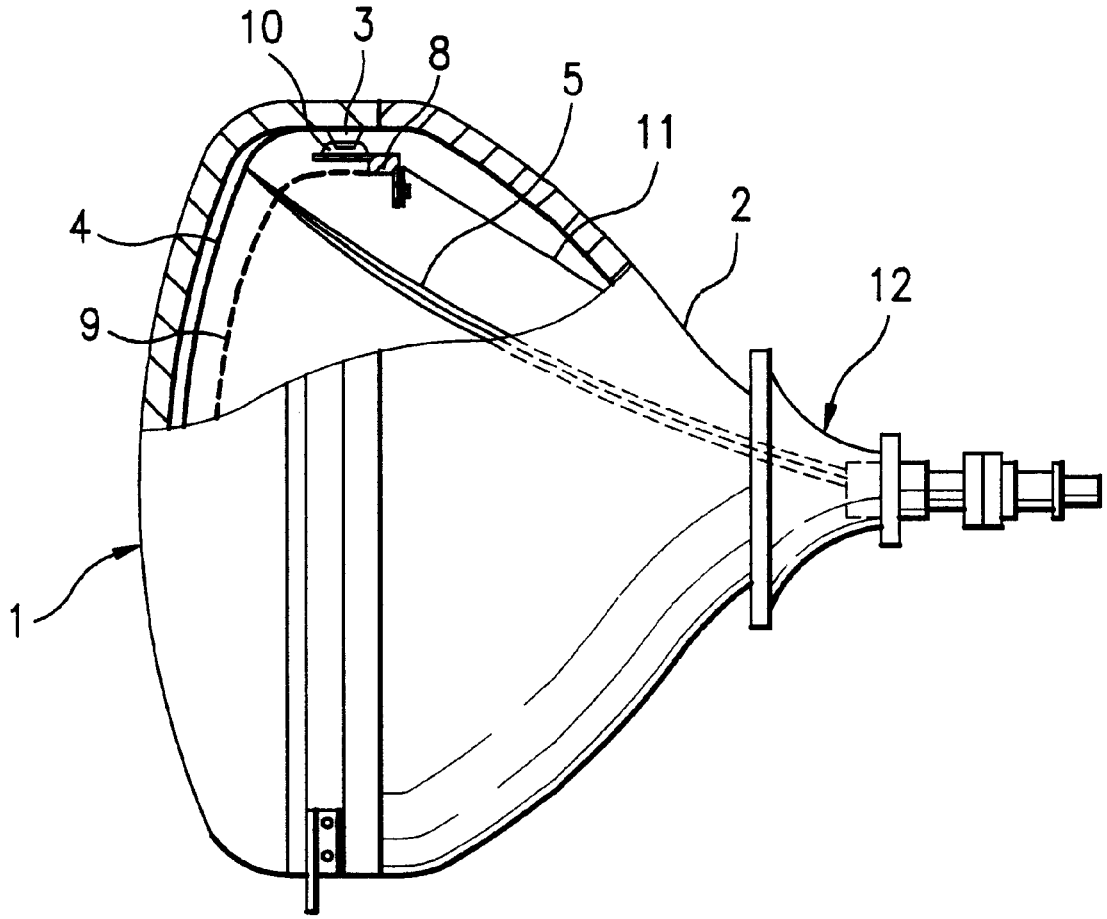
FIG. 1 Related Art
FIG. 1 illustrates a section of a related art Braun tube.
Figure 2:
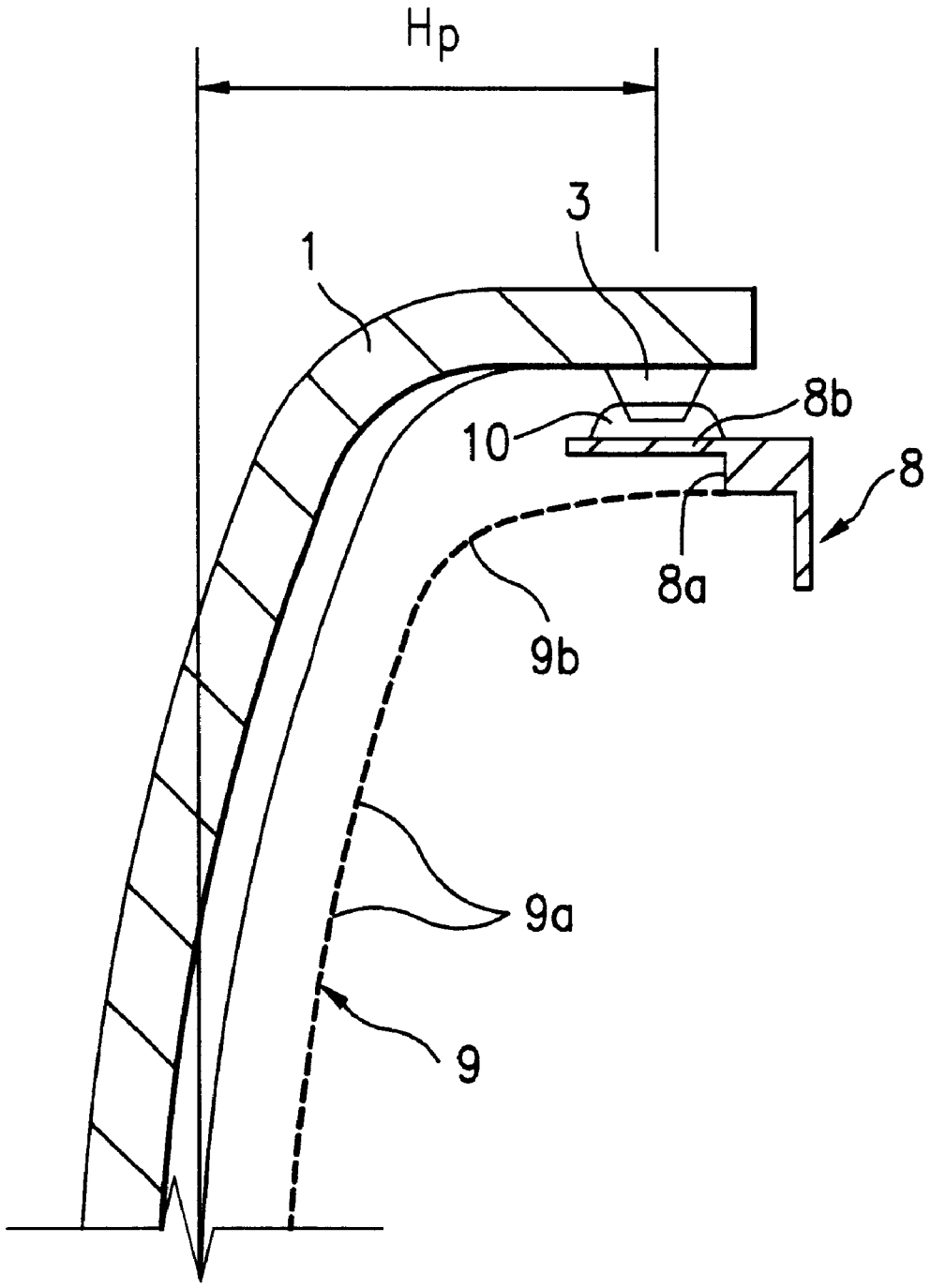
FIG. 2 Related Art
FIG. 2 illustrates an enlarged plan view of "A" part in FIG. 1.
Figure 3:
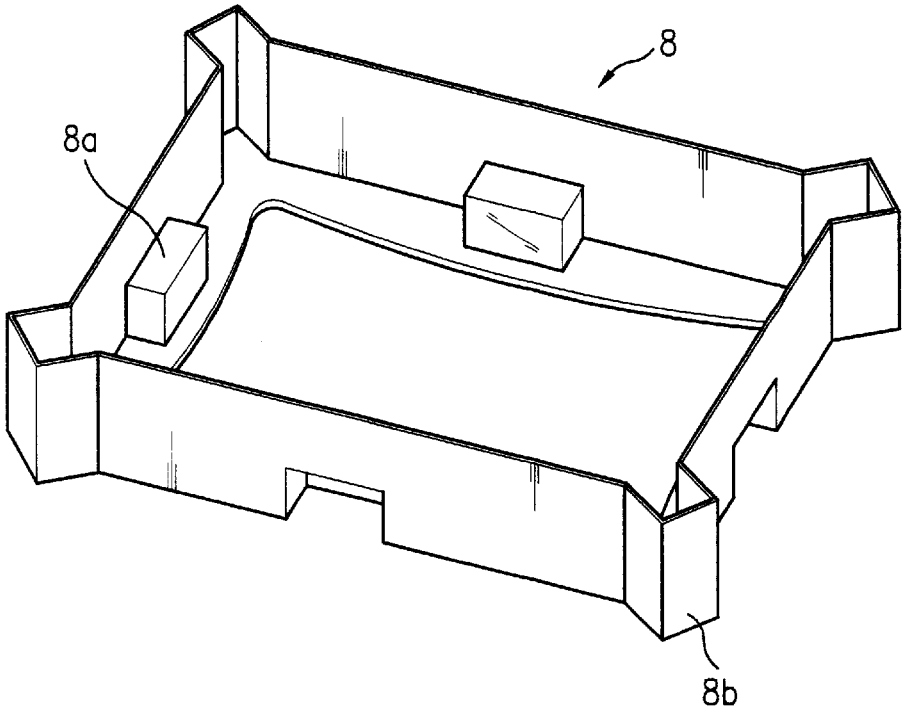
FIG. 3 Related Art
FIG. 3 illustrates a perspective view, of a related art frame in a Braun tube.
Figure 4:
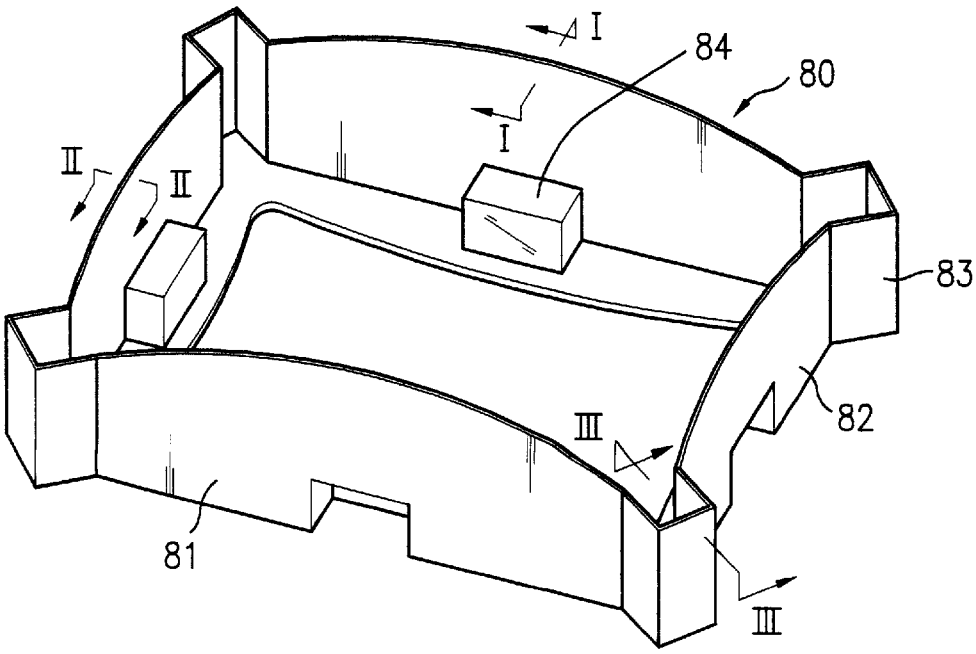
FIG. 4 illustrates a perspective view of a frame in a Braun tube in accordance with a preferred embodiment of the present invention.
Figure 5A:
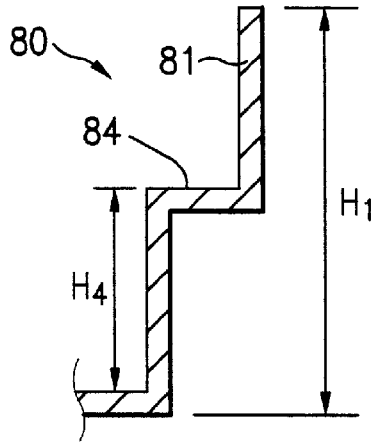
FIG. 5A illustrates a section across line I—I in FIG. 4.
Figure 5B:
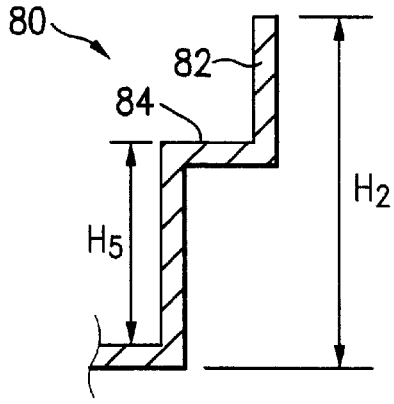
FIG. 5B illustrates a section across line II—II in FIG. 4.
Figure 5C:
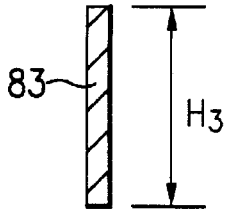
FIG. 5C illustrates a section across line III—III in FIG. 4.

Reference will now be made in detail to the preferred embodiments of the present invention, examples of which are illustrated in the accompanying drawings. FIG. 4 illustrates a perspective view of a frame in a Braun tube in accordance with a preferred embodiment of the present invention, FIG. 5A illustrates a section across line I—I in FIG. 4, FIG. 5B illustrates a section across line II—II in FIG. 4, and FIG. 5C illustrates a section across line III—III in FIG. 4. Explanations of parts duplicated with the related art will be omitted as the parts are explained in the explanation of the related art and parts identical to the related art will be given the same reference symbols.

The following ideal features of a frame are taken into consideration in the present invention.

The frame should maintain a pass through position of the electron beams 5 in a stable state even if a thermal expansion occurs due to a temperature rise of the frame caused by striking of the electron beams 5 during operation of the Braun tube.

An overall position of the frame should be maintained to be always fixed at a position inside of the panel 1 for preventing the shadow mask 9 from vibrations caused by energy transmitted from an external impact or a speaker.

The variation of landing with the geomagnetism dependent on area and direction of the Braun tube operation should be minimum.

According to this, the present invention suggests enlarging a volume of the frame 80, and improvement of bead 84 formed on the frame for reinforcing weakness resulting from the enlarged frame 80.

In this instance, designs of respective portion sizes of the frame of the present invention is analyzed by using the finite element method, i.e., an optimal design is achieved as a result of verification from an actual measurement.

The present invention will be explained in more detail.

A height $H_1$ of a long side 81 of the frame 80 is set to be within a range of (0.8–0.9)×(a height Hp from a center of the stud pin 3 to a center of an inside surface of the panel 1), and heights $H_2$ and $H_3$ of a short side 82 and corner side 83 of the frame 80 are set to be within a range of (0.7–0.85)×(the height $H_1$ of the long side 81 of the frame 80). In this instance, the height $H_2$ of the short side 82 of the frame 80 may be set to be within a range of (0.6–0.7)×(the height Hp from the center of the stud pin 3 to the center of the inside surface of the panel 1), and the height $H_3$ of the corner side 83 of the frame 80 may be set to be within a range of (0.55–0.7)×(the height Hp from the center of the stud pin 3 to the center of the inside surface of the panel 1), individually. A bead 84 is projected from an inside of the long side 81 of the frame 80 with a height $H_4$ within a range of (0.3–0.5)×(the long side 83 height of the frame 80), and a bead 84 is projected from an inside of the short side 82 of the frame 80 with a height $H_5$ within a range of (0.2–0.4)×(the short side 82 height of the frame 80).

In comparison to the related art, it can be known that the frame of the present invention has an overall size significantly greater than the frame of the related art, and the heights of the long sides 81, the short sides 82, and the corner sides 83 are different from one another, which may be compared as shown in tables 1 and 2.

TABLE 1

| | Present invention | Related art |
|---|---|---|
| Height of corner side (mm) | 50 | 40.10 |
| Height of long side (mm) | 70.5 | 66.74 |
| Height of short side (mm) | 57 | 42.87 |

TABLE 2

| | | Present invention | Related art |
|---|---|---|---|
| bead at center of long side | height (mm) | 25 | 20 |
| | width (mm) | 15 | 12 |
| | length (mm) | 65 | 62 |
| bead at center of long side | height (mm) | 15 | 10 |
| | width (mm) | 14 | 9 |
| | length (mm) | 65 | 60 |

Table 1 shows heights of respective parts of the frame, and table 2 shows heights, widths and lengths of respective beads. Frame characteristics improved by the structure of the present invention will be explained in detail.

First, since an overall height of the frame 80 is increased, a rise of a temperature is lower compared to an amount of heat, to reduce the thermal expansion of the frame 80, that in turn reduces variation of landing. The reduced thermal expansion of the frame 80 also reduces an amount of expansion the frame 8 affects the shadow mask 9, that reduces variation of the landing, i.e., reduces variation of position of the selective transmission of the electron beams 5, which can be known clearly from table 3 which shows a variation of landing in doming in the related art and the present invention.

TABLE 3

| Position | Present invention max. | Present invention stable | Related art max. | Related art stable |
|---|---|---|---|---|
| Doming portion | 12 μm | 0 μm | 22 μm | −9 μm |
| End of long axis | 7 μm | 3 μm | 17 μm | −2 μm |
| Corner portion | 7 μm | 6 μm | 16 μm | −6 μm |

That is, as shown in table 3, the variation of landing is reduced significantly by optimizing a shape of the frame 80.

Second, by improving a shape of the bead 84 of the improved frame 80, vibration of the shadow mask 9 can be reduced. The vibration of the shadow mask by an energy from an external impact or a speaker during operation of the Braun tube can be reduced by the beads 84 of the present invention. That is, by increasing a contact surface of the bead 84 with a skirt portion 9*b* of the shadow mask 9 further, an overall fastening of the shadow mask can be made further firm. Different from the related art in which a size of the bead 8*a* also increases in proportion to an increase of an overall size of the frame 8, a size of the bead 8*a* is changed as much as a characteristics of the frame 80 is dropped for compensating the overall characteristics. That is, it can be know from table 2 with ease that the size of the bead 84 of the present invention is greater than the size of bead 8*a* formed in the related art. And, it can also be knows from the measurement that the greater the contact area between the shadow mask 9 and the frame 80, the smaller the howling on the screen of the Braun tube.

Third, as the heights $H_1$, $H_2$, and $H_3$ of the frame 80 increase, the variation of landing affected by geomagnetism is reduced. That is, an overall gap between the panel 1 and the frame 80 is reduced as the heights $H_1$, $H_2$, and $H_3$ of the frame 80 are increased according to the present invention. And, opposite to this, the inside larger space of the frame 80 reduces a magnetic flux density at a central portion of the frame 80, and the magnetic flux is concentrated at a periphery of inside of the frame 80. Accordingly, the variation of landing caused by the geomagnetism can be reduced. In general, though a magnetic shielding is changed by the inner shield 11, the aforementioned effect of magnetic shielding may be obtained only by changing a position of the frame 80 in such a structure as the present invention, which can be easily obtained from resultants shown in table 4.

TABLE 4

| | Present invention | Related art |
|---|---|---|
| Shift of beam after demagnetization (max.) | East-West: 25 μm | East-West: 42 μm |

Table 4 compares a maximum shift of the electron beam after demagnetization in the present invention and the related art. As can be known from table 4, the structure of the present invention can reduce an electron beam shift by 17 μm in comparison to the related art. Such a reduction of electron beam shift further enhances the geomagnetic field shielding effect, that reduces the variation of the electron beam landing, and flicker of the image.

As has been explained, by optimizing respective heights of the frame to satisfy various requirements for the Braun tube at the same time when an overall size of the frame is increased, the Braun tube can be made stable from influences from doming, howling, and geomagnetism. The setting of frame design criteria with ranges considering relations with other parts of the Braun tube permits convenience of design. Thus, the present invention is very useful for industry. It will be apparent to those skilled in the art that various modifications and variations can be made in the frame in a Braun tube of the present invention without departing from the spirit or scope of the invention. Thus, it is intended that the present invention cover the modifications and variations of this invention provided they come within the scope of the appended claims and their equivalents.

What is claimed is:

1. A Braun tube, comprising:

a shadow mask;

a panel for supporting the shadow mask;

stud pins fitted between the shadow mask and the panel; and, a frame of substantially rectangular form having a long side with a height in a range of (0.8–0.9)×(a height from a center of one of said stud pins to a central point of an inside surface of the panel), wherein said central point intersects with the tube axis, and a short side and a corner side each with a height in a range of (0.7–0.85)×(the height of the long side).

2. A Braun tube as claimed in claim 1, wherein the height of the short side of the frame is in a range of (0.6–0.7)×(a height from said center of the stud pin to a central point of an inside surface of the panel).

3. A Braun tube as claimed in claim 1, wherein the height of the corner side of the frame is in a range of (0.55–0.7)×(a height from a center of the stud pin to said central point of an inside surface of the panel).

4. A Braun tube as claimed in claim 1, further comprising a bead projected from an inside of the long side of the frame having a height in a range of (0.3–0.5)×(the height of the frame in the long side), and another bead projected from an inside of the short side of the frame having a height in a range of (0.2–0.4)×(the height of the frame in the short side).

* * * * *